US009062927B1

(12) United States Patent
Tepaske

(10) Patent No.: US 9,062,927 B1
(45) Date of Patent: Jun. 23, 2015

(54) SHOTGUN ADAPTER FOR REMOTE WEAPON STATION

(75) Inventor: Derrick Marcus Tepaske, King George, VA (US)

(73) Assignee: The United States of America as Represented by the Secretary of the Navy, Washington, DC (US)

( * ) Notice: Subject to any disclaimer, the term of this patent is extended or adjusted under 35 U.S.C. 154(b) by 162 days.

(21) Appl. No.: 13/385,028

(22) Filed: Jan. 10, 2012

(51) Int. Cl.
*F41A 25/00* (2006.01)
*F41A 25/18* (2006.01)

(52) U.S. Cl.
CPC ..... *F41A 25/18* (2013.01)

(58) Field of Classification Search
USPC ..... 89/42.01, 27.3, 37.04, 27.11; 42/94, 42/69.01, 90
See application file for complete search history.

(56) References Cited

U.S. PATENT DOCUMENTS

| | | | | | |
|---|---|---|---|---|---|
| 499,315 | A * | 6/1893 | Borchardt | 89/132 |
| 4,012,860 | A * | 3/1977 | Auger | 42/94 |
| 4,787,288 | A * | 11/1988 | Miller | 89/27.3 |
| 4,905,396 | A | 3/1990 | Bechtel | 42/127 |
| 5,220,116 | A * | 6/1993 | Sheets | 42/94 |
| 5,272,955 | A * | 12/1993 | Bond et al. | 89/37.04 |
| 5,394,633 | A | 3/1995 | Alessandri, Jr. | 42/79 |
| 5,438,787 | A | 8/1995 | McMaster et al. | 42/106 |
| 6,023,875 | A | 2/2000 | Fell et al. | 42/146 |
| 6,223,644 | B1 * | 5/2001 | Troncoso | 89/136 |
| 7,047,863 | B2 * | 5/2006 | Hawkes et al. | 89/37.04 |
| 7,103,999 | B2 * | 9/2006 | Jones | 42/69.01 |
| 7,469,623 | B1 * | 12/2008 | Olcott | 89/27.3 |
| 7,650,826 | B2 * | 1/2010 | Son et al. | 89/27.3 |
| 7,866,247 | B2 * | 1/2011 | Son et al. | 89/27.3 |
| 7,962,243 | B2 * | 6/2011 | Deguire et al. | 700/259 |
| 7,974,736 | B2 * | 7/2011 | Morin et al. | 700/245 |
| 8,113,103 | B2 * | 2/2012 | Beckmann et al. | 89/27.3 |
| 8,234,968 | B2 * | 8/2012 | Hodge | 89/41.05 |
| 8,297,167 | B2 * | 10/2012 | Hoffman | 89/11 |
| 8,375,838 | B2 * | 2/2013 | Rudakevych et al. | 89/27.11 |
| 8,397,621 | B2 * | 3/2013 | Hodge | 89/41.05 |
| 8,448,557 | B2 * | 5/2013 | Hamish et al. | 89/27.12 |
| 8,459,171 | B2 * | 6/2013 | Cottle | 89/37.04 |
| 2007/0051235 | A1 * | 3/2007 | Hawkes et al. | 89/37.04 |

* cited by examiner

*Primary Examiner* — Michelle R Clement
(74) *Attorney, Agent, or Firm* — Gerhard W. Thielman, Esq

(57) ABSTRACT

An attachment is provided for operably connecting a shotgun to a weapons station. The shotgun includes a trigger and a butt stock. The weapons station can accommodate one of a Mk19 grenade launcher, an M2 .50 cal machine gun and an M240G machine gun. The attachment includes a trigger module, a pump grip adapter, and a gun frame. The module actuates the trigger and includes an actuator for pulling the trigger and an adapter for engaging the butt stock. The pump grip adapter includes slots for traveling pins on the weapons station to absorb recoil. The gun frame enables installation of the shotgun therein and mounts the trigger module and the adapter to the weapon station.

3 Claims, 6 Drawing Sheets

SHOTGUN ADAPTER FOR REMOTE WEAPON STATION

STATEMENT OF GOVERNMENT INTEREST

The invention described was made in the performance of official duties by one or more employees of the Department of the Navy, and thus, the invention herein may be manufactured, used or licensed by or for the Government of the United States of America for governmental purposes without the payment of any royalties thereon or therefor.

BACKGROUND

The invention relates generally to shotgun adapters. In particular, the invention relates to adaptation systems that enable a shotgun to be installed onto a remote weapons station.

A variety of small-arms-fire weapons can be installed onto a remote weapons station for infantry support. Such weapons include the Mk19 grenade launcher, M2 .50 cal machine gun, or M240G machine gun.

SUMMARY

Conventional infantry weapon adapters yield disadvantages addressed by various exemplary embodiments of the present invention. In particular, the embodied adapters provide for incorporation of a shotgun to a remote weapons station.

Various exemplary embodiments provide an adapter for operably connecting a shotgun to a weapons platform. The shotgun includes a body, a pump grip, a trigger and a butt stock. The weapons station can similarly accommodate one of a variety of weapons including the Mk19 grenade launcher, the M2 .50 cal machine gun, and the M240G machine gun. The adapter includes a trigger module, a pump grip adapter, a slide release mechanism, a charging linkage, and a gun frame. The module actuates the trigger and includes an actuator for pulling the trigger as well as an adapter for engaging the butt stock.

The pump grip adapter includes a boss and through-hole to interface with the charging linkage. The slide release mechanism allows the gun to be cycled out of sequence. The charging linkage allows the RWS to pump the gun by interfacing with the pump grip adapter and slide release mechanism. The gun frame enables installation of the shotgun therein and mounts the trigger module and the adapter to the station.

BRIEF DESCRIPTION OF THE DRAWINGS

These and various other features and aspects of various exemplary embodiments will be readily understood with reference to the following detailed description taken in conjunction with the accompanying drawings, in which like or similar numbers are used throughout, and in which.

DETAILED DESCRIPTION

In the following detailed description of exemplary embodiments of the invention, reference is made to the accompanying drawings that form a part hereof, and in which is shown by way of illustration specific exemplary embodiments in which the invention may be practiced. These embodiments are described in sufficient detail to enable those skilled in the art to practice the invention.

Other embodiments may be utilized, and logical, mechanical, and other changes may be made without departing from the spirit or scope of the present invention. The following detailed description is, therefore, not to be taken in a limiting sense, and the scope of the present invention is defined only by the appended claims.

Various exemplary embodiments enable a Mossberg 500 or similar shotgun to be mounted in any remote weapon station (RWS) originally designed to hold a weapon, e.g., a Mk19 grenade launcher or an M2 .50 cal machine gun. The M1126 Stryker infantry carrier vehicle represents an exemplary RWS.

In addition to securing the weapon in position, various exemplary embodiments enable the shotgun to be fired remotely and cycled. The exemplary designs provide for quick installation and removal of the shotgun. Conventional designs lack any standard manner to mount a shotgun in a remote gun mount that were originally designed to contain the Mk19 or the M2 .50 cal.

Figure 1A:
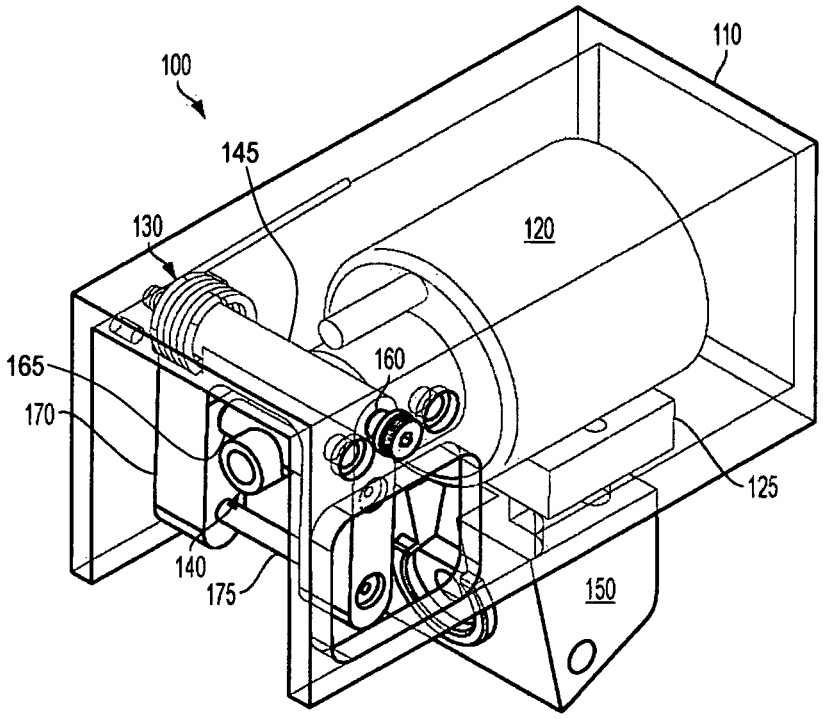
FIG. 1A through 1C are perspective views of a trigger assembly.
Figure 1B:
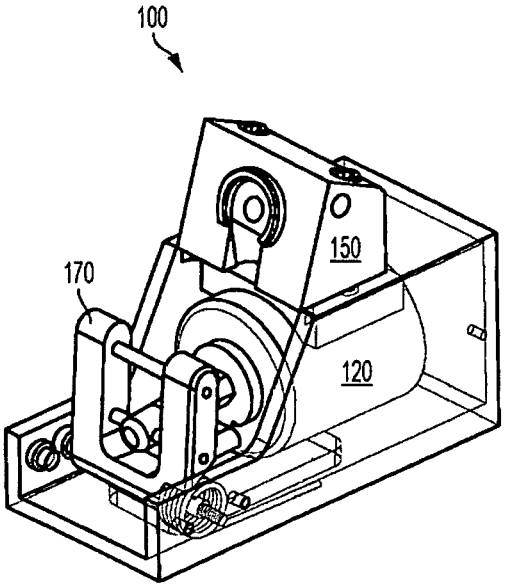
Figure 1C:
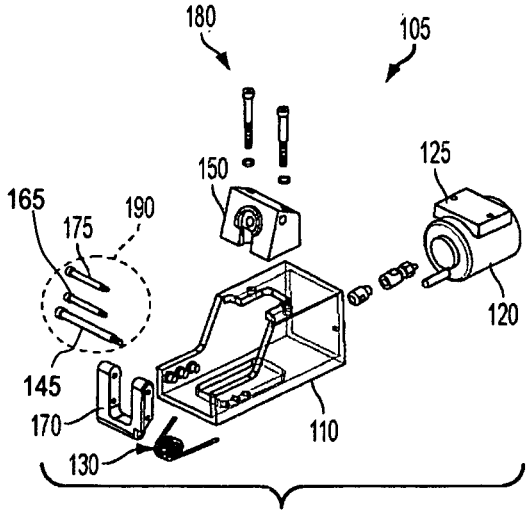

The exemplary fixture can be reduced to five main parts: a Trigger Module or Assembly, a Pump Grip Adapter, a Slide Release Mechanism, a Charging Linkage and a Gun Frame. FIGS. 1A and 1B show isometric assembly views of the Trigger Module 100. FIG. 1C shows an isometric exploded view of The Trigger Module 100 contained within a see-through housing box 110. This box houses a solenoid 120 integrated with a base 125, a helical spring 130, and a linkage 140 that facilitates the remote firing of the shotgun. The spring 130 coils around a transverse rod 145.

The linkage 140 connects to the solenoid 120. The Module 100 bolts onto the rear of the shotgun using a butt stock adapter 150 in place of the standard butt stock. The adapter 150 attaches to the base 125. A shoulder bolt 160 attaches an actuator bridge 170 to the box 110. A mezzanine rod 165 attaches the linkage 140 to the bridge 170. A trigger rod 175 extends across the bridge 170 to engage the shotgun's trigger.

Figure 2A:
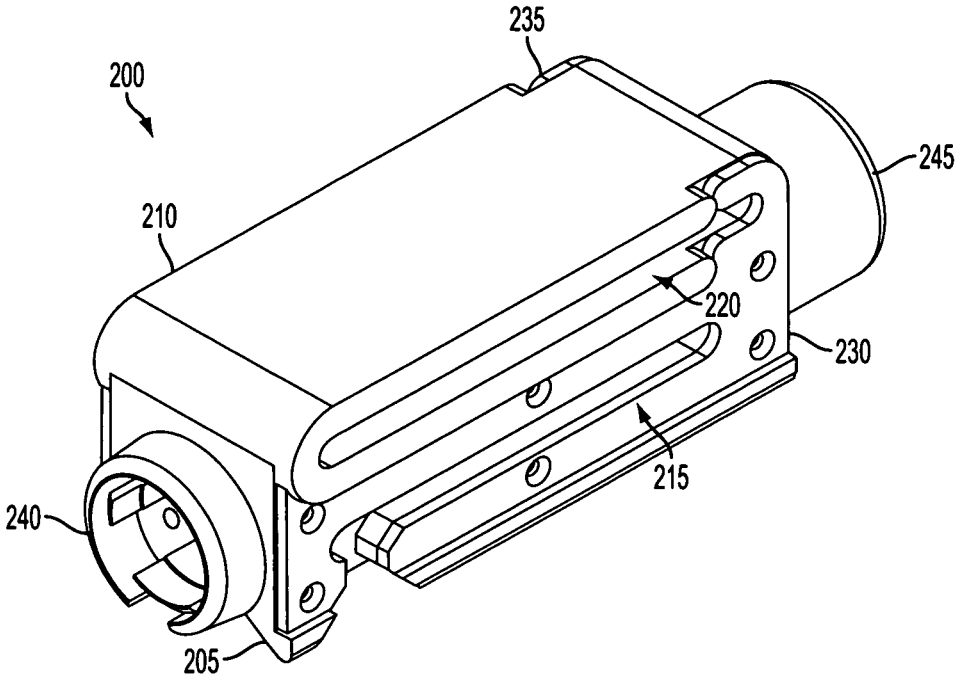
FIG. 2A is a perspective view of a pump grip adapter in a first embodiment.

FIG. 2A shows an isometric view of a first embodiment of the Pump Grip Adapter 200. This Adapter 200 replaces the standard plastic pump grip on the shotgun without any modifications to the weapon. The Adapter 200 includes a boss and through-hole to enable mounting on to the charging linkage. The Adapter 200 includes a housing 205 that includes a cover 210. The housing 205 and cover 210 respectively include lower and upper slider slots 215 and 220 that extend longitudinally and transversely in parallel.

The Adapter 200 includes mount plates 230 and 235 for providing structural support. At the proximal and distal ends, the Adapter 200 includes an ingress 240 and an egress 245, both substantially cylindrical for the Tube Magazine (shown in FIG. 3A) to extend therethrough.

Figure 2B:
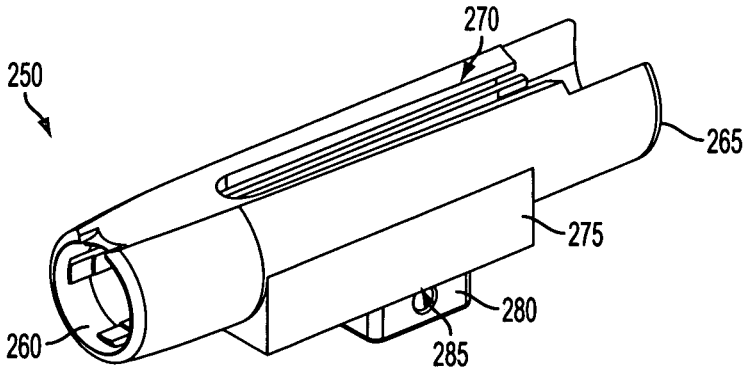
FIG. 2B is a perspective view of a pump grip adapter in a second embodiment.

FIG. 2B shows an isometric view of a second embodiment of the Pump Grip Adapter 250, which includes an ingress 260 at the proximal end and an egress 265 at the distal end. The ingress 260 inserts into the breech opening 240, and the shotgun barrel inserts through the breech 265. A top slot 270 provides clearance for the Adapter 250 to travel longitudinally along the shotgun barrel during recycling. The Adapter 250 includes bosses 275 and 280, along with a through-hole 285 for connecting a charging mechanism (shown in FIG. 5).

Figure 3A:
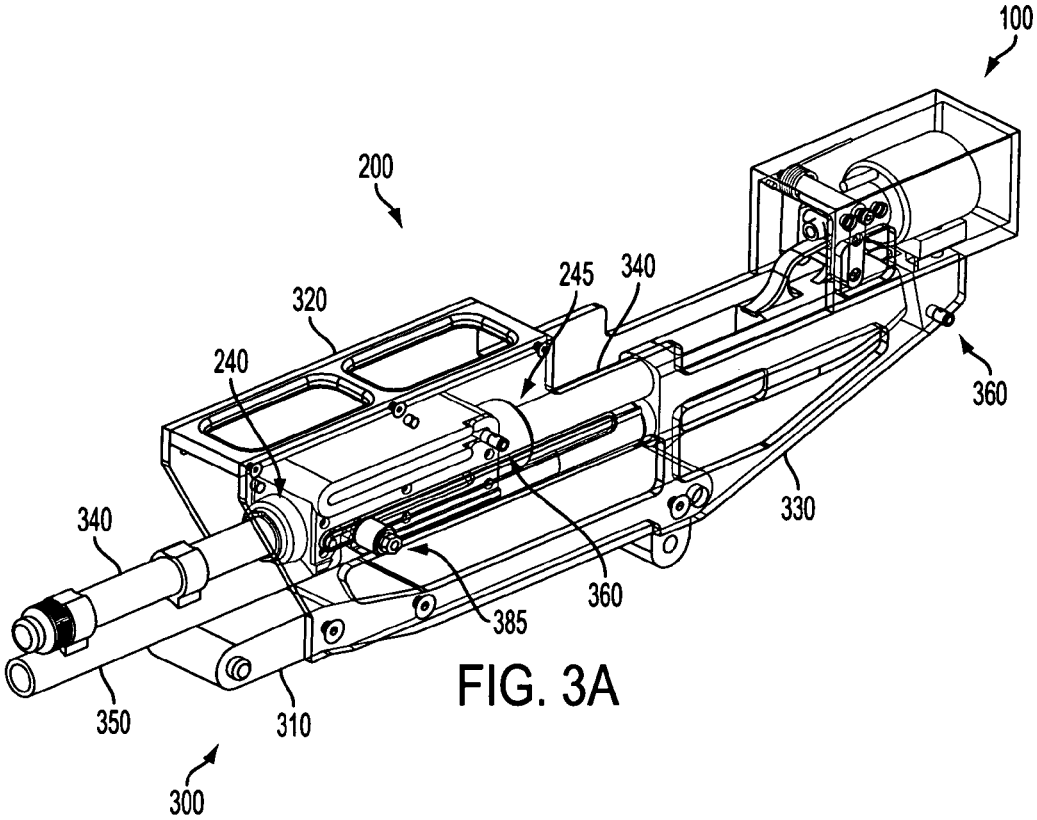
FIG. 3A is an inverted perspective view of a shotgun adapter assembly.
Figure 3B:
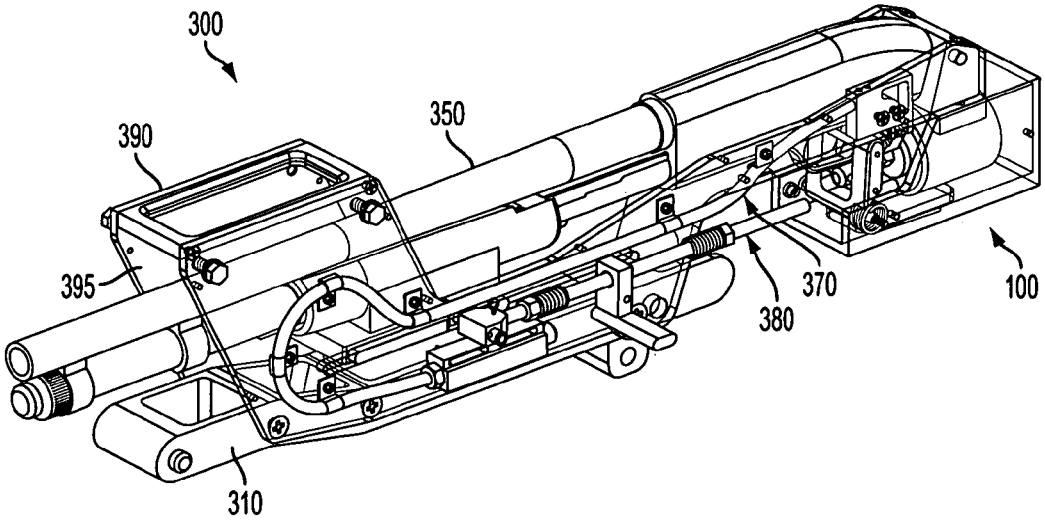
FIG. 3B is a upright perspective view of a shotgun adapter assembly with charging linkage and slide release mechanism.

FIGS. 3A and 3B show respective isometric assembly views of first and second embodiments of the Adapter Assembly 300 that enables the shotgun to be fired remotely and cycled. Viewed from above in FIG. 3A, the first embodiment, featuring the Adapter 200, includes distal and proximal frames 310 and 320 attaching together around the shotgun by side flanges 330. A Tube Magazine 340 holding additional ammunition rounds passes through the Pump Grip Adapter 200, with the ammunition loading aftward (to the right). The Tube Magazine 340 is depicted by a proximal tube portion that extends forward from the muzzle 245, and a distal tube portion that extends aft from the breech 240. A shotgun barrel 350 (with muzzle end pointing left) extends parallel to the Tube Magazine 340: shown underneath in FIG. 3A and above in FIG. 3B.

Release pins 360 enable convenient removal of the shotgun without disassembling the Adapter Assembly 300. Viewed from below in FIG. 3B, the second embodiment includes a Slide Release Mechanism 370 and a Charging Linkage 380. A boss 385 connects the Adapter 200 along the slot 215 with the Charging Linkage 380 behind the shotgun's trigger on the side flanges 330. The second embodiment also includes the distal frame 310 and a proximal frame 390 connected by side flanges 395.

Figure 4A:
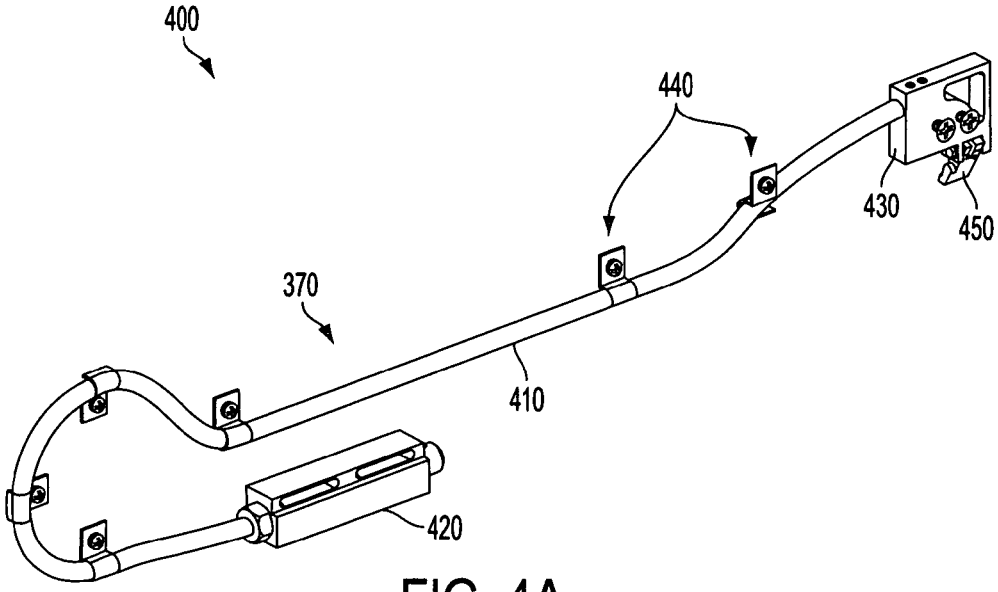
FIGS. 4A and 4B are perspective views of a slide release mechanism.
Figure 4B:
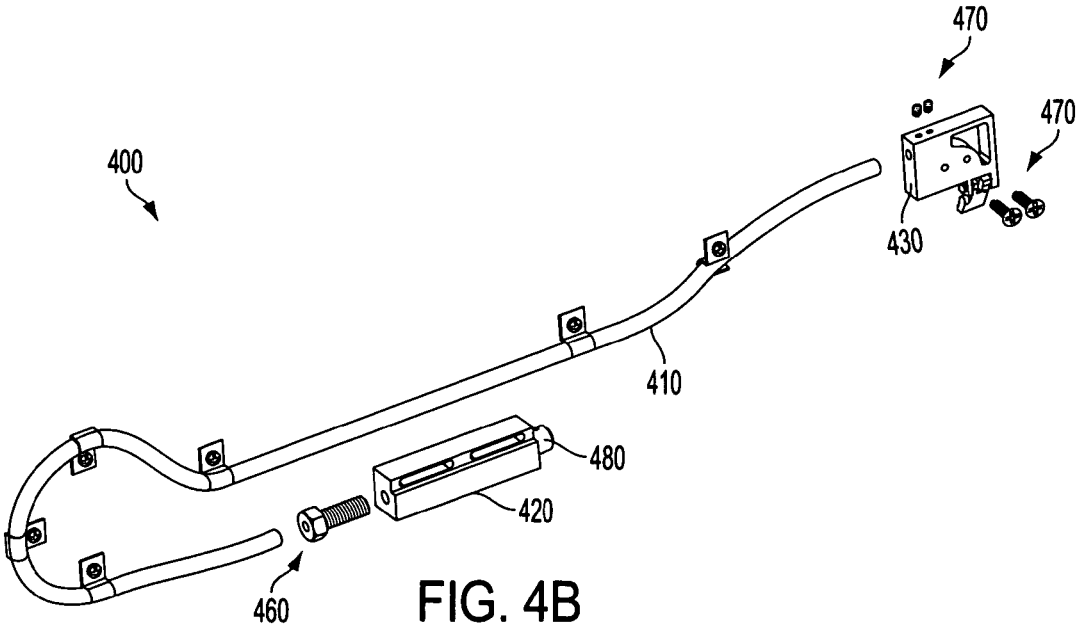

FIGS. 4A and 4B show isometric assembly and exploded views 400 of the Slide Release Mechanism 370 that enables cycling of the shotgun weapon regardless of the firing sequence. A cable within a jacket 410 connects a plunger housing 420 with a release housing 430 and secures to the RWS by screw tabs 440. The Charging Linkage 380 depresses an internal plunger within the plunger housing 420, which in turn actuates a trigger lever 450. Axial travel of the plunger can be adjusted by a set screw 460 that inserts into the jacket 410 and the release housing 430. A spring within the plunger housing 420 applies force to the trigger lever 450 and to a slide release button on the shotgun. This enables the shotgun to be pumped to empty the ammunition chamber whether or not a round was fired. Threaded bolts 470 secure the trigger lever 450 to pivot within the release housing 430 to disengage the trigger rod 175 by turning laterally. A slide release plunger 480 within the slide release housing 420 is depressed though interaction with the Charging Linkage 380. The linear motion of the plunger 480 transmits though the cable within the jacket 410 to rotate the slide release lever 450 within the release housing 430.

Figure 5A:
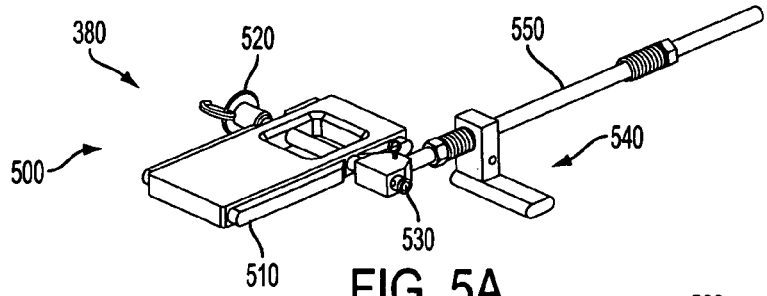
FIGS. 5A and 5B are perspective views of a charging linkage.
Figure 5B:
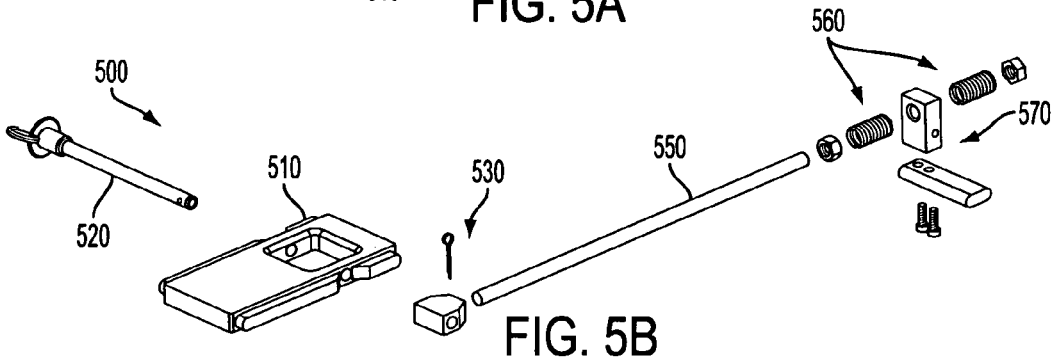

FIGS. 5A and 5B show isometric assembly and exploded views 500 of the Charging Linkage 380 that enables the RWS to actuate the Pump Grip Adapter 200. A charging tray 510 mates to the Pump Grip Adapter 200. The pin 360 connects the charging tray 510 to the charging rod 520, which slides through an RWS interface tab 530. A slider assembly 540 slideably attaches to an axial rod 550. Nuts 560 and springs 570 on the rod 550 enable mechanical adjustment. The motion to operate the charging mechanism resident on the RWS transmits through the components of the Charging Linkage 380 to both release the slide and cycle the weapon.

Figure 6A:
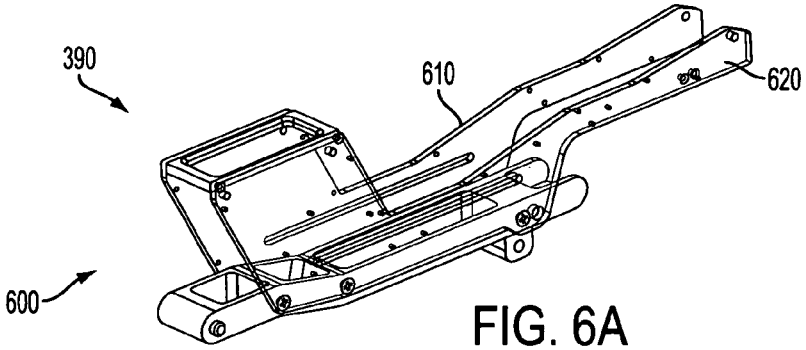
FIGS. 6A and 6B are perspective views of a frame that secures the adapter.
Figure 6B:
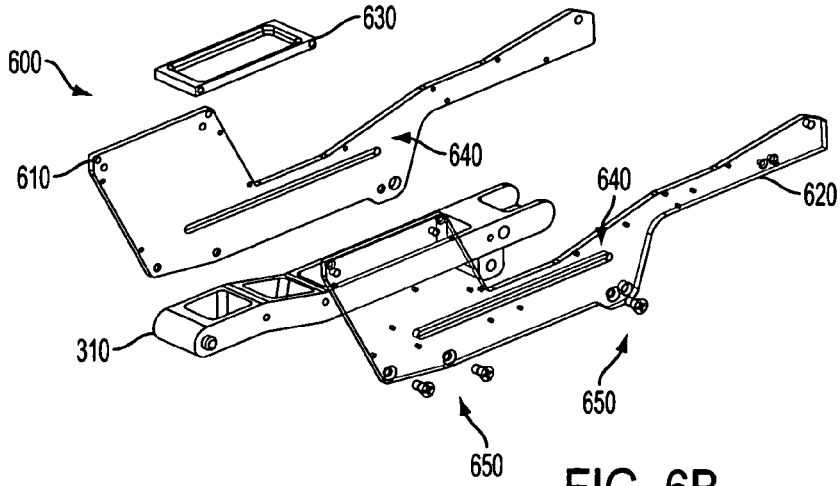

FIGS. 6A and 6B show isometric assembly and exploded views of the Frame 600 (as the second embodiment) that secures components of the Adapter 200 together for assembling in the RWS. The structure of the Frame 600 enables bolting other equipment above itself. Mountable stocks 610 and 620 (corresponding to the flanges 395) provide a platform for the fore housing 310 that contains the Adapter 200. An aft housing 630 (corresponding to the frame 390) also connects to the stocks 610 and 620 to support the Trigger Module 100.

A first tube 540 attaches to the first connector 250, and a second tube 350 attaches to the second connector 260. Two quick-release pins 465 enable release of the shotgun without removing the entire adapter. A linkage connects the pump action pin 580 to the RWS charging actuator.

Figure 7:
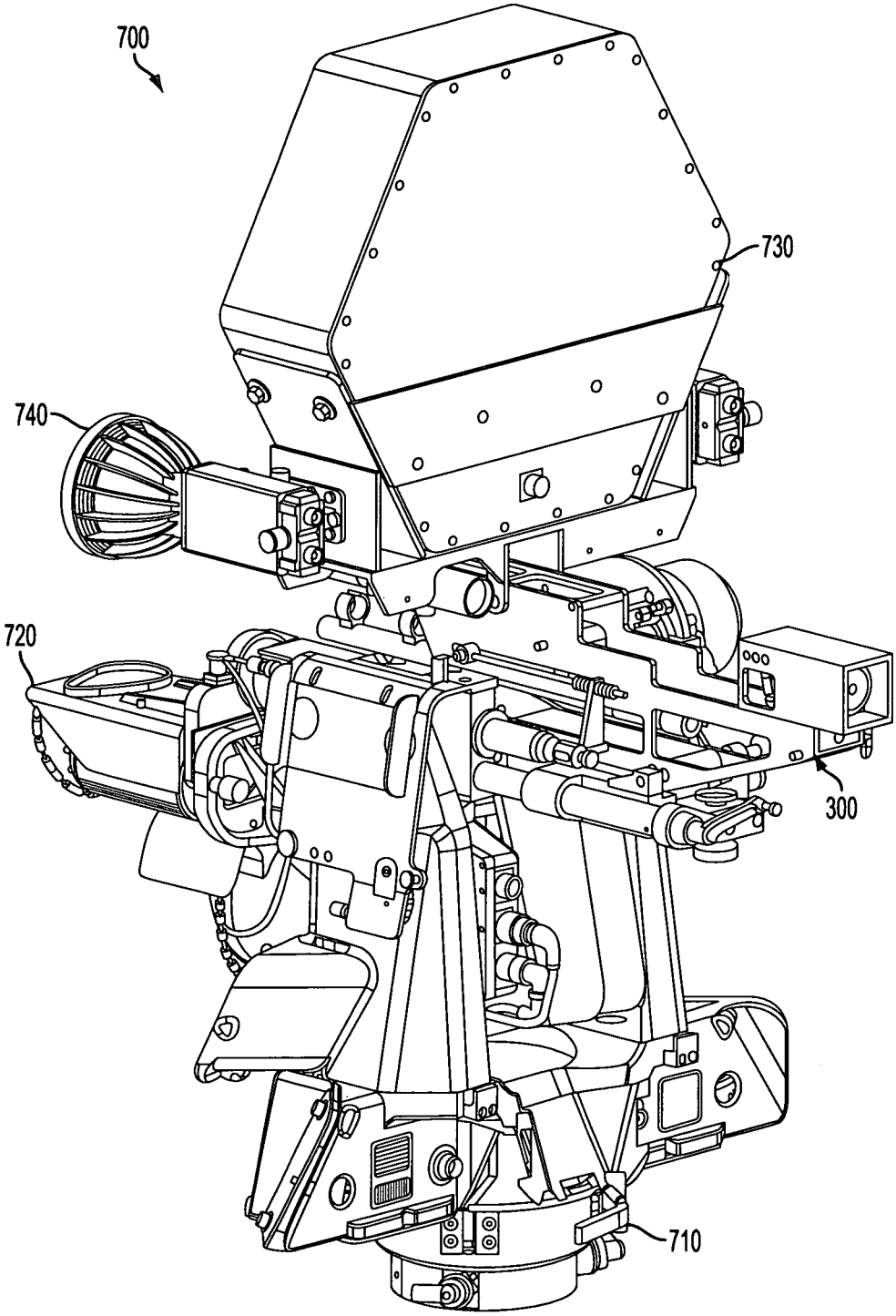
FIG. 7 is a perspective view of an integrated weapons station.

FIG. 7 shows an isometric view of the RWS 700 with the Assembly 300 (that includes the Frame 600 for the Shotgun Adapter 200 and accompanying Trigger Module 100 mounted thereon). The RWS 700 includes a base platform 710 that supports additional equipment mounted onto the side 720 and on the top 730 such as antennas 740.

The RWS Shotgun Adapter as an assembly 300 is implemented and operated in the following manner.

Replace the standard shotgun butt stock with the butt stock adapter 180,

Replace the pump grip with the pump grip adapter, e.g., as shown in the first embodiment 200, Install the assembled frame 300 into remote weapon station 700 and secure with the pins 360, Attach pump action linkage to the boss 385, Attach additional equipment to the adapter 200, Install Shotgun and secure with the pins 360, Plug solenoid cable into the remote weapon station 700, Load the weapon, Operate trigger to fire using RWS controls, Eject spent shell using the actuator through the RWS controls, thereby completing the operation.

Various exemplary embodiments provide advantages in enabling a shotgun capability to be adapted to any remote gun mount that is capable of firing the Ml19 grenade launcher, the M2 .50 cal machine gun, or the M240G machine gun without any modifications being made to the mount.

Materials used for the initial invention are aluminum and steel. Alternative materials could be used depending on their strength characteristics. Alternative solenoids can be used as long as they meet the force and power requirements. The original design incorporated the Mossberg 500 series shotgun although other shotguns are adaptable. The equipment located on top of the adapter is specific to the original application; other equipment can be installed as required.

While certain features of the embodiments of the invention have been illustrated as described herein, many modifications, substitutions, changes and equivalents will now occur to those skilled in the art. It is, therefore, to be understood that the appended claims are intended to cover all such modifications and changes as fall within the true spirit of the embodiments.

What is claimed is:

1. An adapter attachment for operably connecting a shotgun to a weapon station, said shotgun having a trigger and a butt stock, said trigger being pivotable in a pull direction, said station having a tube magazine to feed ammunition to said shotgun and a controller to issue a firing command to said shotgun, said attachment being distinguishable from said shotgun and said station being distinguishable and comprising:

a trigger module for actuating the trigger of the shotgun, said module having an actuator that applies force to the trigger in the pull direction in response to the firing command from the station, and an abutment adapter for engaging the butt stock of the shotgun, the shotgun firing a first round in response to said firing command;

a pump grip adapter disposed around the tube magazine for pumping the shotgun to eject a spent cartridge from firing said first round;

a slide release mechanism that connects an internal plunger to a trigger release after activation of said actuator loading a second round from the tube magazine into the shotgun;

a charging linkage disposed adjacent said slide release mechanism for connecting said plunger to said pump grip adapter; and a gun frame for installing the shotgun therein and mounting said trigger module, said pump grip adapter, said slide release mechanism and said charging linkage to the weapon station.

2. The attachment according to claim 1, wherein said actuator comprises a solenoid to pull a lever that engages the trigger upon actuation, and a bridge that pivots as said lever translates and returns said lever to initial position upon deactivation of said solenoid.

3. The attachment according to claim 1, wherein said pump grip adapter incorporates a laterally traversing longitudinally extending slot longitudinally in said gun frame for enabling a boss to slide parallel therein in the pull direction.

* * * * *